United States Patent [19]

Winkles

[11] 4,082,150

[45] Apr. 4, 1978

[54] LAND LEVELLING EQUIPMENT

[76] Inventor: Dwayne L. Winkles, P.O. Box 401, Farwell, Tex. 79325

[21] Appl. No.: 787,349

[22] Filed: Apr. 14, 1977

[51] Int. Cl.[2] ..... E02F 3/64

[52] U.S. Cl. ..... 172/780; 172/763; 172/767; 172/770; 403/400

[58] Field of Search ..... 172/26.5, 26.6, 145, 172/159, 160, 197, 199, 200, 669, 671, 677, 762, 763, 767, 770, 771, 779, 780; 37/41, 42 R, 53, 42 VL; 280/476 A; 403/386, 400

[56] References Cited

U.S. PATENT DOCUMENTS

| | | | |
|---|---|---|---|
| 1,120,823 | 12/1914 | Le Clair | 172/26.5 |
| 2,593,880 | 4/1952 | Heavilin | 172/780 |
| 2,719,369 | 10/1955 | Lindbeck | 172/199 |
| 3,448,813 | 6/1969 | Rogers | 172/763 X |
| 3,500,936 | 3/1970 | Vigen | 172/763 X |
| 3,608,643 | 9/1971 | Flood et al. | 172/200 |
| 3,612,187 | 10/1971 | Glass | 172/780 |
| 4,029,155 | 6/1977 | Blair et al. | 172/763 |

*Primary Examiner*—Richard T. Stouffer
*Attorney, Agent, or Firm*—Wendell Coffee

[57] ABSTRACT

A basic land leveller has the side plates and moldboard carriers. Angle irons are welded to the top of the carriers to form the moldboard carriers into a rigid structure and to form a guide for the wheel booms extending behind the leveller and a tongue extending in front of the leveller. The equipment is shipped with the wheel booms and tongue aligned with the moldboard carriers and the buyer bolts the booms into the boom guides and the tongue into the tongue guides.

The moldboards are formed of a plate broken three times to form three panels with a blade bolted to the bottom panel.

5 Claims, 6 Drawing Figures

28
22
26
18
12
4
24
20
5
42
30
16
14
32
40
36
34
52
44
54
56
46
48
50
30°
45°

LAND LEVELLING EQUIPMENT

CROSS-REFERENCE TO RELATED APPLICATIONS

None. However, applicant filed Disclosure Document No. 057,128 on Jan. 21, 1977, which document concerns this application; therefore, by separate paper, it is respectfully requested that the document be retained.

BACKGROUND OF THE INVENTION (1) Field of the Invention

This application relates to earth working for agricultural land levelling, and more particularly to scrapers between front and rear ground supports.

(2) Description of the Prior Art

In irrigated agriculture, it is important that the land be reasonably level.

To achieve this, a moldboard or scraper is mounted between widely spaced ground supports. Over a year before filing this patent application, I was making a land leveller having two moldboards which extended laterally of the direction of draft. The wheel booms extended from the back to adjustable wheel carriers so that the leveller could be adjusted so that more dirt was carried by either the front moldboard or the back moldboard. The tongue extended forward to a towing vehicle which could raise or lower the longue so that the moldboards either took a deeper or a shallower cut.

Also, I made the moldboards by welding four channel irons to a pipe, then cutting the pipe in quadrants so that four moldboards (each being one-fourth of a cylinder) were formed.

Before this invention, I had only a limited market because the equipment was too wide to be shipped.

At the time of filing this patent application, I was aware of the following U.S. patents:

Spicer — U.S. Pat. No. 970,966
Bender — U.S. Pat. No. 998,740
Moore — U.S. Pat. No. 1,128,486
Williams — U.S. Pat. No. 1,157,136
Burrell — U.S. Pat. No. 1,496,621
Sokolik — U.S. Pat. No. 3,299,965
Tonsfeldt — U.S. Pat. No. 3,680,648

SUMMARY OF THE INVENTION (1) New and Different Function

I have solved the problem of shipping the land levellers by manufacturing and shipping the land levellers without the tongue or the wheel booms attached. I make a good solid, rigid frame by welding angle irons to the top of the channels forming the moldboard carrier at the place of manufacture. Therefore, with this rigid, welded structure, a wide durable article of earth working equipment is produced. Then, the buyer bolts the welded booms and the tongue into the guides formed by the angle irons.

Also, I have formed a less expensive moldboard by using a plate and breaking or bending it three times. It will be understood that normally the moldboards are segments of cylinders; however, it is very expensive to mold them so as to form a segment of a circular cylinder. Also, there is no need for this shape. By breaking a single plate to make four panels, I form a moldboard which meets all the requirements for the purposes of this equipment.

Thus it may be seen that with the invention as described, I have made a land leveller which is adapted to be shipped after manufacture. The length of the equipment shipped is only the length of the moldboards and their carriers, whereas the width of the equipment is only slightly more than the spacing between the two moldboards. This is schieved by placing the tongue and the moldboard booms aligned with the moldboards for shipping. Even so, there is no need for the buyer to perform any welding to make the moldboard carriers rigid.

Thus it may be seen that I have achieved results wherein the final function of the finished product is far greater than the sum of the functions of the individual parts, such as wheels, booms and moldboards.

(2) Objects of this Invention

An object of this invention is to provide a device for levelling land

Other objects are to achieve the above with a device that is sturdy, compact, durable, lightweight, simple, safe, efficient, versatile, ecologically compatible, energy conserving, and reliable, yet inexpensive and easy to manufacture, ship, assemble, adjust, operate and maintain.

The specific nature of the invention, as well as other objects, uses, and advantages thereof, will clearly appear from the following description and from the accompanying drawing, the different views of which are not scale drawings.

BRIEF DESCRIPTION OF THE PREFERRED EMBODIMENT

Figure 4:
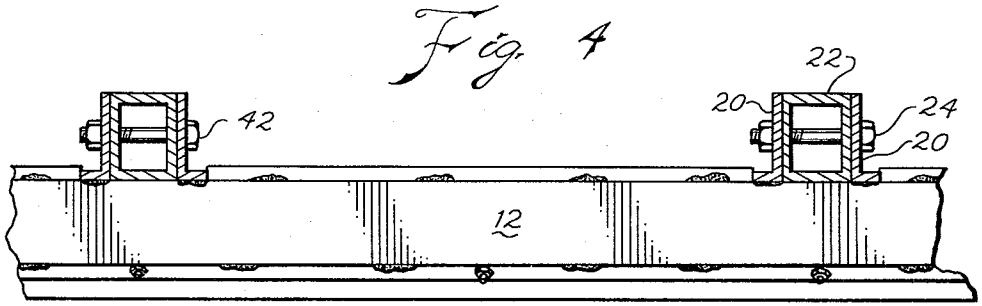
FIG. 4 is a sectional view taken substantially on line 4—4 of FIG. 3.
Figure 1:
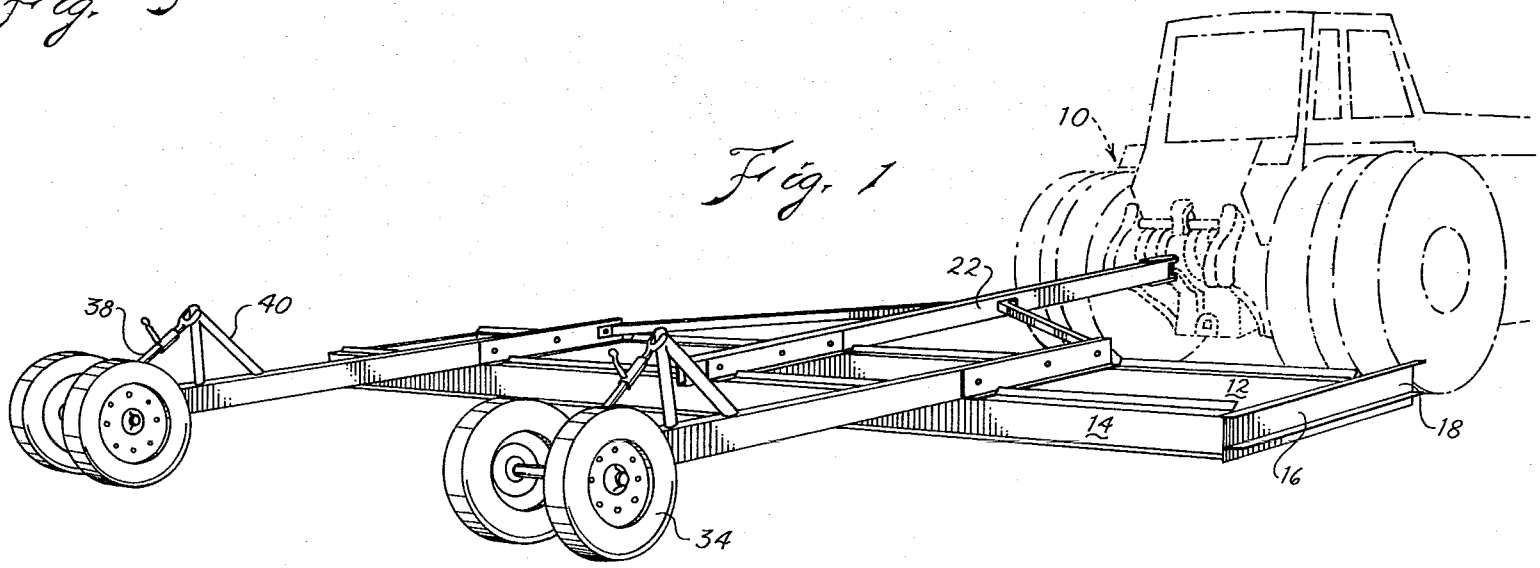
FIG. 1 is a perspective view of an embodiment of this invention attached to a towing vehicle, which is shown in phantom lines.

Referring to the drawing, there may be seen the land levelling equipment as attached to towing vehicle 10. It will be understood that the towing vehicle is a standard farm tractor having a vehicle hitch which may be raised and lowered by power means associated therewith. The vehicle 10 forms a means for pulling the land leveller in a direction of draft.

The leveller itself has front or forward moldboard carrier 12 and rear moldboard carrier 14. The forward and rear moldboard carriers are at right angles or normal to the direction of draft.

The side plates 16 extend from the rear or back moldboard carrier 14 forward and have a forward extension 18 which is forward of the front moldboard carrier 12. The side plates are rigidly attached and connected to the moldboard carriers as by welding. The side plates 16 are aligned with the direction of draft.

In addition, the moldboard carriers are connected by angle irons. Specifically, a pair of spaced-apart angle irons form tongue guide 20. It may be seen that these angle irons are securely connected, as by welding, to the top of the forward and rear moldboard carriers 12 and 14. Also, it may be seen that the angle irons face away from each other, i.e., that they form an unobstructed space between them, so, it may be described that the tongue guide is vertically upward. The tongue guide 20 is normal to the moldboard carriers, meaning that it is aligned with the direction of draft.

Tongue 22 fits snugly within the tongue guide, i.e., between the two angle irons and is held securely in place by tongue bolts 24. The tongue is braced by tongue angle braces 26, which extend from about the midpoint of the distance between the front moldboard carrier 12 and hitch 28 on the front of the tongue 22. The hitch 28 forms means for attaching the tongue 22 to the vehicle hitch of the vehicle 10. The angles 26 are conveniently bolted to the tongue 22 and to boom guides 30 at the front moldboard carrier 12.

The boom guides 30 also extend vertically upward and are formed by a pair of angle irons which are securely and rigidly attached, as by welding, to the front and rear moldboard carriers 12 and 14. The space between the two angle irons of the boom guide 30 is also clear. The boom guides 30 are also aligned with the direction of draft. Wheel booms 32 are snugly bolted between the boom guides. The boon guides extend behind the rear moldboard carrier to ground engaging wheels 34. The ground engaging wheels are carried by arm 36 which is pivoted to its wheel boom 32. The ground engaging wheels 34 may be adjusted up and down by use of turnbuckle 38. The turnbuckle extends from the arm 36 to the top of A-frame 40, which is mounted on the rear of the wheel boom 32.

The wheel boom 32 and the tongue 22 are made of rectangular, tubular material. The wheel booms 32 are held securely to the boom guides 30 by boom bolts 42. Therefore, it may be seen that by removing the boom bolts and the tongue bolts, the booms and tongue can be removed from their assembled position and placed across the land leveller parallel to the moldboard carriers 12 and 14. Therefore, it may be seen that packaged for shipment, the package is the length of the moldboard carriers and the width is the length of the sideplate 16. As noted above, fully assembled, the land leveller is too bulky to be shipped. However, when the land leveller is assembled at the site of its use, the rigidity and the strength does not depend upon having the boom bolts 42 and the tongue bolts 24 extremely tight. The tongue and the boom are securely fastened in place with only intermediate tightening of the relatively few boom bolts and tongue bolts. Also, of course, the tongue is further held in place by the angle braces 26.

Figure 5:
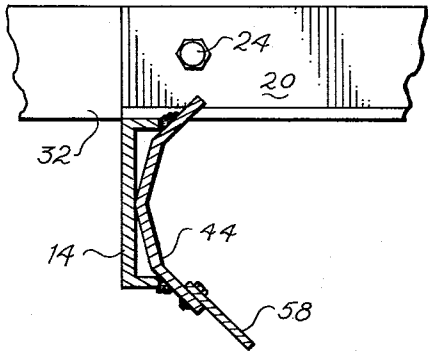
FIG. 5 is a sectional view taken substantially on line 5—5 of FIG. 3.
Figures 2, 3, 6:
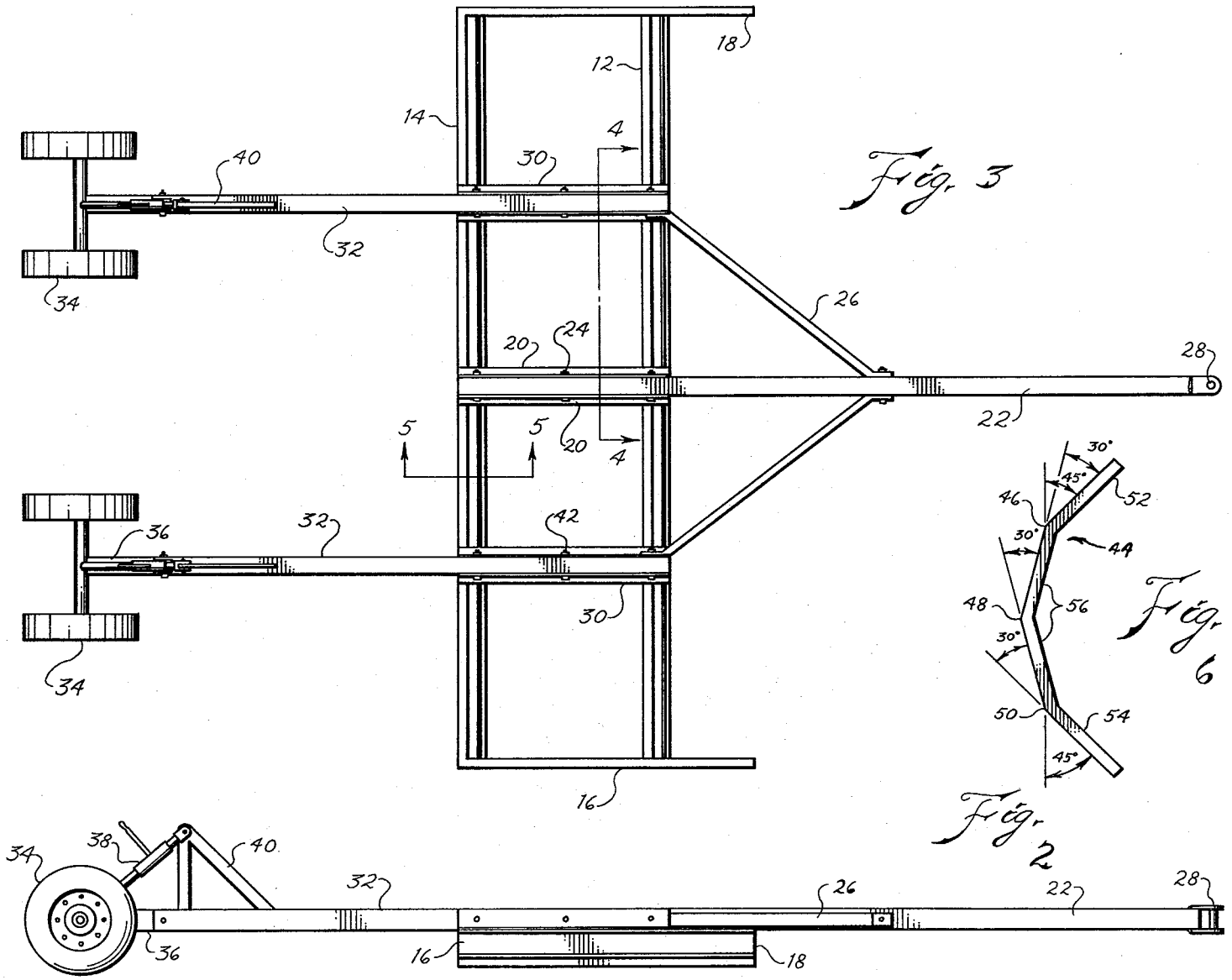
FIG. 2 is a side elevational view thereof.
FIG. 3 is a top plan view thereof.
FIG. 6 is an end view of the improved moldboard I use with this equipment.

Referring to FIGS. 5 and 6, new moldboard 44 is used. The front moldboard and rear moldboard are identical. The moldboard is made of an integral plate of material which has been broken three times at top break 46, mid-break 48 and bottom break 50. Thus are formed four panels, which are top panel 52, bottom panel 54 and two middle panels 56. Each of the panels is planar. Each break is about 30° so that each panel is angled at about 30° to its adjacent panel. Each of the panels is approximately of the same width. Since the panels are angled at 30° to each other, the top panel will be angled at 90° to the bottom panel.

Each of the moldboard carriers 12 and 14 are made of channel material, commonly called "channel iron". The moldboards are welded into the channel irons as particularly shown. The mid-break 48 is centered within the channel very close to the back of the channel. The top and bottom panels will each be approximately 45° from vertical.

Scraper blade 58 is bolted to the bottom panel 54. The scraper blade is made of a steel particularly adapted for such use, such use normally being called "plow steel". A steel strap of this quality is readily available commercially to farm implement makers and is commonly used in making blades or stalk cutters.

As an aid to correlating the terms of the claims to the exemplary drawing, the following catalog of elements is provided:

10 vehicle
12 forward moldboard
14 rear moldboard
16 side plate
18 forward extension
20 tongue guide
22 tongue
24 tongue bolts
26 angle braces
28 hitch
30 boom guide
32 wheel boom
34 ground-engaging wheels
36 arm
38 turnbuckle
40 A-frame
42 boom bolts
44 moldboard
46 top break
48 mid-break
50 bottom break
52 top panel
54 bottom panel
56 mid panels
58 blade The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by the defined in the following claims. The restrictive description and drawing of the specific example above do not point out what an infringement of this patent would be, but are to enable the reader to make and use the invention.

I claim as my invention:

1. In a land leveler to be pulled in a direction of draft having a. side plates aligned with the direction of draft on each side thereof,
b. front and back moldboard carriers normal to the direction of draft rigidly connected to the side plates,
c. the side plates extending forward of the front moldboard carrier,
d. widely separated wheel booms aligned with the direction of draft extending from the moldboard carriers rearwardly to adjustable wheels, and
e. a tongue aligned in the direction of draft from the moldboard carriers forward to a hitch;

THE IMPROVED STRUCTURE COMPRISING:

f. vertical upward tongue guides aligned with the direction of draft, rigidly connected to the top of the moldboard carriers, g. said tongue bolted within the tongue guides, and
h. vertical upward boom guides aligned with the direction of draft rigidly connected to the top of the moldboard carriers,
j. said booms bolted within said boom guides, and
k. said vertical upward guides being angle irons welded to the front moldboard carrier and also to the rear moldboard carrier and extending therebetween.

2. The invention as defined in claim 1 with additional limitations of k. each of said moldboard carriers is a channel beam,
m. a moldboard being made of
(i) an integral plate of
(ii) four planar panels,
(iii) each panel is of equal width and length to each other panel and
(iv) angled about 30° to adjacent panel so that
(v) the outside panels are angled 90° to each other,
n. said moldboard attached within the carrier channel with the top and bottom panel angled about 45° from vertical, and
o. a scraper blade bolted to the bottom panel of the moldboard.

3. The invention as defined in claim 1 wherein said wheel booms have k. ground engaging wheels thereon, and
m. adjustable means on the wheels for raising and lowering the wheels.

4. The invention as defined in claim 3 with additional limitations of o. each of said moldboard carriers is a channel beam,
p. a moldboard being made of
(i) an integral plate of
(ii) four planar panels,
(iii) each panel is of equal width and length to each other panel and
(iv) angled about 30° to adjacent panel so that
(v) the outside panels are angled 90° to each other,
q. said moldboard attached within the carrier channel with the top and bottom panel angled about 45° from vertical, and
r. a scraper blade bolted to the bottom panel of the moldboard.

5. In a land leveler to be pulled in a direction of draft having a. side plates aligned with the direction of draft on each side thereof,
b. front and back moldboard carriers normal to the direction of draft rigidly connected to the side plates,
c. the side plates extending forward of the front moldboard carrier,
d. widely separated wheel booms aligned with the direction of draft extending from the moldboard carriers rearwardly to adjustable wheels and
e. a tongue aligned in the direction of draft from the moldboard carriers forward to a hitch,

THE IMPROVED STRUCTURE COMPRISING:

f. each of said moldboard carriers is a channel beam,
g. a moldboard being made of
(i) an integral plate of
(ii) four planar panels,
(iii) each panel is of equal width and length to each other panel and
(iv) angled about 30° to adjacent panel so that
(v) the outside panels are angled 90° to each other,
h. said moldboard attached within the carrier channel with the top and bottom panel angled about 45° from vertical, and
j. a scraper blade bolted to the bottom panel of the moldboard.

* * * * *